United States Patent [19]

Acimovic et al.

[11] 4,388,161

[45] Jun. 14, 1983

[54] ACID TIN BATH AND TIN/LEAD BATH RESPECTIVELY FOR THE ELECTRODE-POSITION OF LUSTROUS COATINGS OF TIN AND TIN/LEAD RESPECTIVELY

[75] Inventors: Simeon Acimovic; Karl-Heinz Lindemann; Volker G. Kunz, all of Trebur, Fed. Rep. of Germany

[73] Assignee: Elektro-Brite GmbH & Co. KG, Trebur, Fed. Rep. of Germany

[21] Appl. No.: 392,451

[22] Filed: Jun. 24, 1982

Related U.S. Application Data

[63] Continuation-in-part of Ser. No. 233,171, Feb. 10, 1981, abandoned.

[51] Int. Cl.[3] ..... C25D 3/32; C25D 3/60

[52] U.S. Cl. ..... 204/43 S; 204/54 R; 546/270; 549/453; 549/454; 549/455

[58] Field of Search ..... 204/43 S, 54 R, 120, 204/123; 549/453, 454, 455; 546/270

[56] References Cited

FOREIGN PATENT DOCUMENTS 56-139692 10/1981 Japan ..... 204/43 S

*Primary Examiner*—G. L. Kaplan

*Attorney, Agent, or Firm*—Wallenstein, Wagner, Hattis, Strampel & Aubel

[57] ABSTRACT

Bright deposits of tin and tin/lead alloys by electrocoating are obtained by using a bath containing tin salts and, optionally, lead salts, aldehydes and/or ketones as brighteners as well as surfactants besides sulfuric acid and/or borofluohydric acid wherein part or all of the aldehydes and/or ketones are replaced by a cyclic reaction product of one or more aromatic aldehydes and epihalohydrin of the general formula

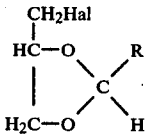

(Hal being chlorine or bromine, R being a phenyl, naphthyl or pyridyl radical which is optionally substituted by one to three members of the group consisting of chlorine, bromine or fluorine atoms, alkyl or alkoxy groups having 1 to 3 carbon atoms, carboxy and hydroxy groups). Preferably the cyclic reaction product is contained in the bath in an amount of from 0.1 to 2 g/liter of the bath.

4 Claims, No Drawings

ACID TIN BATH AND TIN/LEAD BATH RESPECTIVELY FOR THE ELECTRODE-POSITION OF LUSTROUS COATINGS OF TIN AND TIN/LEAD RESPECTIVELY

This application is a continuation-in-part application of pending U.S. application Ser. No. 233,171, filed Feb. 10, 1981 and now abandoned.

The invention relates to an acid tin bath and tin/lead bath respectively for the electrodeposition of lustrous coatings of tin and tin/lead alloys respectively onto substrates such as iron or copper or alloys of these metals, such as bronze or brass.

From U.S. Pat. specification No. 3,769,182 an acid galvanic bath for the electrodeposition of tin and tin/-lead layers is known which contains tin and, optionally, lead ions, borofluohydric acid, an alkoxylated fatty acid alkylolamide having 2 to 30 alkyleneoxy groups as surfactant and one or more aromatic aldehydes, namely, 2,4- and 2,6-dichloro benzaldehyde, respectively, or benzaldehyde, 2,5-dimethoxybenzaldehyde, toluylaldehyde, cinnamic aldehyde or anisaldehyde. The aromatic aldehydes are used in combination with an aromatic amine with the exception of the aromatic haloaldehydes which are used together with formaldehyde and 1,2,4-trichlorobenzene and/or an amine. Thus the teaching of this patent resides in the use of certain combinations of aromatic aldehydes with other compounds for obtaining lustrous deposits since particularly in the absence of amines the aldehyde does not act as a brightener.

In the narrow range of current densities of from 0.2 to 1.2 amps/dm$^2$ only dull coloured deposits can be produced. Further it is found that the inferior quality of these deposits is also obtained when using the aromatic amine o-toluidine together with the aromatic aldehydes which is disclosed as indispensable combination. When using 2,4-dichlorobenzaldehyde together with other additives it is found that current densities of up to 6.5 amps/dm$^2$ result in dull deposits.

Although it is known from German patent specification No. 2,506,158 to avoid such disadvantages by using naphthalene monoaldehyde as additional brightening agent as well as, optionally, acrylic acid, methacrylic acid and the lower alkyl esters and amides thereof it has been found that tar-like oxidation products are formed which interfere with the electrodeposition of bright deposits of tin and tin/lead respectively and disturb the normal use cycle of the bath.

It has been found that surprisingly these disadvantages do not occur but that in a broad range of low current densities of from 0.01 to 10 amps/dm$^2$ equally bright to brilliant soft deposits of tin and tin/lead can be produced if certain cyclic acetals are used as brighteners.

The acid tin bath and tin/lead bath respectively for the electrodeposition of lustrous tin coatings and tin/-lead coatings respectively containing tin salts and optionally lead salts, aldehydes and/or ketones as brighteners as well as surfactants besides sulfuric acid and/or borofluohydric acid is characterized in that it contains in place of part or all of the aldehydes and/or ketones a cyclic reaction product of one or more aromatic aldehydes and epihalohydrin of the general formula

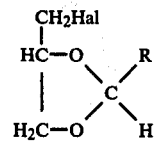

(Hal=chlorine or bromine, R=a phenyl, naphthyl or pyridyl radical optionally substituted by one to three members of the group consisting of chlorine, bromine and fluorine atoms, alkyl and alkoxy groups having 1 to 3 carbon atoms, carboxy and hydroxy groups).

These cyclic acetals are very stable in solution in 2N to 3N sulfuric acid of temperatures up to 100° to 120° C.

Aldehydes which are suited for manufacturing the acetals are the following:

2-Methoxy-4-hydroxybenzaldehyde
o-Methoxybenzaldehyde
4-Hydroxy-3-methoxybenzaldehyde
3,4-Methoxybenzaldehyde
o-Chlorobenzaldehyde
2,4-Dichlorobenzaldehyde
2,6-Dichlorobenzaldehyde
p-Chlorobenzaldehyde
o-Phthalaldehyde
1-Naphthalenealdehyde
2-Naphthalenealdehyde
Pyridine-3-aldehyde In order to enhance solution of the additives known co-solvents may be used in the bath as it is known in the art. Examples for suitable solvents are isopropanol, methanol, diethyleneglycol monomethyl ether and ethyleneglycol monomethyl ether and others.

The preferred surfactants or emulsifiers as used in the bath of the invention are amphoteric, cationic and nonionic surface active agents and blends thereof. Especially preferred are alkyl phenols such as in particular nonyl phenol condensed with about 10 to 30 moles of ethylene oxide per mole of alkyl phenol.

Further other known additives can be used such as aromatic aldehydes and ketones in combination with the acetals used as brighteners in the bath according to the invention. Also antioxidants such as tricholorobenzene, cresol sulfonic acid in particular in the form of an alkali metal salt and similar substances may be used.

The concentration of the acetal and acetal mixtures, respectively, in the bath of the invention amounts to 0.1 to 2 g/liter, in particular of from 0.4 to 0.8 g/liter of the bath. The concentration of the emulsifier amounts from 2 to 20 g/liter and the concentration of the solvent amounts from 2 to 20 percent by volume.

EXAMPLE 1

| Ingredient | g/liter |
|---|---|
| $SnSO_4$ | 2.5 |
| $H_2SO_4$ | 120 |
| Formaldehyde | 3 cm$^3$/l |
| Cresolsulfonic acid, Na—salt | 10 |
| *Reaction product of 4-hydroxy-4-methoxy-benzaldehyde and epichlorohydrin | 0.2 |
| *Reaction product of 2,4-dichlorobenzaldehyde and epichlorohydrin | 0.3 |
| Condensation product of 1 mole of nonylphenol | 8 |

-continued

| Ingredient | g/liter |
|---|---|
| and 14 moles of ethyleneoxide (emulsifier) | |

*The reaction products were formed by reacting the aldehyde with epichlorohydrin, in a molar ratio of 1:1, as follows: The aldehyde was mixed with approximately an equal volume of water and heated to 70° C. to 80° C. About 1/10 mole of concentrated sulfuric acid was added followed by the epichlorohydrin. The mixture was maintained at a temperature of approximately 80° C. The formed acetal precipitated as a white substance which was dissolved in a 10% solution of ethanol in water. The resulting solution was used as such in the electroplating bath.

EXAMPLE 2

| Ingredient | g/liter |
|---|---|
| $SnSO_4$ | 45 |
| $H_2SO_4$ | 120 |
| Formaldehyde | 5 $cm^3/l$ |
| *Reaction product of 3,4-dimethoxy-benzaldehyde and epichlorohydrin | 0.3 |
| *Reaction product of p-chlorobenzaldehyde and epichlorohydrin | 0.3 |
| Condensation product of 1 mole of nonylphenol and 14 moles of ethyleneoxide (emulsifier) | 8 |

*The reaction products were formed by reacting the aldehyde with epichlorohydrin, in a molar ratio of 1:1, as follows: the aldehyde was mixed with approximately an equal volume of water and heated to 75° C. About 1/10 mole of concentrated sulfuric acid was added. Thereafter, the epichlorohydrin was added, and the reaction mixture was maintained at a temperature of 80° C. The formed acetal precipitated as a white substance. The precipitate was dissolved in a 10% aqueous ethanol solution. The resulting solution was used as such in the electroplating bath.

Electrocoating was carried out in the baths of Examples 1 and 2 using a Hull cell with a current density of 1 amp/10 min at a temperature of 25° C. At 0.01-5 amps/$dm^2$. Brilliant tin deposits were obtained using a substrate of iron sheet (0.3 mm thick).

EXAMPLE 3

The following bath was prepared (amounts in g/liter):

| Ingredient | g/liter |
|---|---|
| Tin fluoborate | 15 |
| Lead fluoborate | 5 |
| Boric acid | 10 |
| Borofluohydric acid | 100 |
| *Reaction product of 2,6-dichlorobenzaldehyde and epichlorohydrin | 0.3 |
| Condensation product of 1 mole of nonylphenol and 10 moles of ethylene oxide | 10 |

*The reaction product was formed as described in Examples 1 and 2.

Electrocoating was carried out in a Hull cell with a current density of 2 amps/5 min under mechanical stirring. A bright tin deposit was obtained at 0.1 to 10 amps/$dm^2$ using a substrate of iron sheet 0.3 mm thick.

We claim:

1. Acid tin bath and tin/lead bath respectively for the electrodeposition of lustrous tin coatings and tin/lead coatings respectively containing tin salts and optionally lead salts, aldehydes and/or ketones as brighteners as well as surfactants besides sulfuric acid and/or borofluohydric acid characterized in that it contains in place of part or all of the aldehydes and/or ketones a cyclic reaction product of one or more aromatic aldehydes and epihalohydrin of the general formula

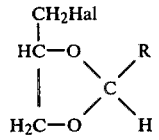

(Hal=chlorine or bromine, R=a phenyl, naphthyl or pyridyl radical optionally substituted by one to three members of the group consisting of chlorine, bromine and fluorine atoms, alkyl and alkoxy groups having 1 to 3 carbon atoms, carboxy and hydroxy groups).

2. Tin bath and tin/lead bath respectively as claimed in claim 1 characterized in that it contains in addition an antioxidant.

3. Tin bath and tin/lead bath respectively as claimed in claim 2 characterized in that it contains trichlorobenzene or cresol sulfonic acid or an alkali metal salt thereof as antioxidant.

4. Tin bath and tin/lead bath respectively as claimed in claim 1 characterized in that it contains the brightener in a amount of from 0.1 to 2 g/liter of the bath.

* * * * *